US009869464B2

(12) United States Patent
Manahan

(10) Patent No.: US 9,869,464 B2
(45) Date of Patent: Jan. 16, 2018

(54) HERMETICALLY-SEALED LIGHT FIXTURE FOR HAZARDOUS ENVIRONMENTS

(71) Applicant: Joseph Michael Manahan, Manlius, NY (US)

(72) Inventor: Joseph Michael Manahan, Manlius, NY (US)

(73) Assignee: Cooper Technologies Company, Houston, TX (US)

( * ) Notice: Subject to any disclaimer, the term of this patent is extended or adjusted under 35 U.S.C. 154(b) by 222 days.

(21) Appl. No.: 14/863,192

(22) Filed: Sep. 23, 2015

(65) Prior Publication Data

US 2017/0082279 A1 Mar. 23, 2017

(51) Int. Cl.

| | |
|---|---|
| ***F21V 31/00*** | (2006.01) |
| ***F21V 25/12*** | (2006.01) |
| *F21V 15/01* | (2006.01) |
| *F21V 3/02* | (2006.01) |
| *F21V 29/76* | (2015.01) |
| *F21Y 115/10* | (2016.01) |

(52) U.S. Cl.

CPC ..... *F21V 31/005* (2013.01); *F21V 25/12* (2013.01); *F21V 3/02* (2013.01); *F21V 15/01* (2013.01); *F21V 29/763* (2015.01); *F21Y 2115/10* (2016.08)

(58) Field of Classification Search

CPC ..... F21V 31/005; F21V 25/12; F21V 29/763; F21V 3/02; F21V 15/01; F21Y 2115/10

USPC ..... 362/249.01, 311.02, 267

See application file for complete search history.

(56) References Cited

U.S. PATENT DOCUMENTS

| | | | | |
|---|---|---|---|---|
| 4,692,208 | A | 9/1987 | Khoe et al. | |
| 4,768,070 | A | 8/1988 | Takizawa et al. | |
| 5,020,065 | A | 5/1991 | Tada | |
| 5,632,551 | A * | 5/1997 | Roney | B60Q 1/2696 257/E25.028 |
| 6,431,728 | B1 * | 8/2002 | Fredericks | B60Q 1/2696 340/901 |
| 6,480,389 | B1 | 11/2002 | Shie et al. | |
| 7,255,460 | B2 | 8/2007 | Lee | |
| 7,348,203 | B2 | 3/2008 | Kaushal et al. | |
| 7,677,765 | B2 | 3/2010 | Tajul et al. | |
| 7,744,236 | B2 | 6/2010 | Hsu et al. | |
| 8,075,152 | B2 | 12/2011 | Chen et al. | |

(Continued)

FOREIGN PATENT DOCUMENTS

| | | |
|---|---|---|
| DE | 102009005547 | 7/2010 |
| KR | 2011108626 | 10/2011 |

OTHER PUBLICATIONS

S. Surikov, International Search Report and Written Opinion issued in International Application PCT/US2016/053025, completion date Dec. 8, 2016, dated Dec. 29, 2016, 7 pages, Federal Institute of Industrial Property, Moscow, Russia.

*Primary Examiner* — Laura Tso

(74) *Attorney, Agent, or Firm* — King & Spalding LLP

(57) ABSTRACT

A light fixture is disclosed herein. The light fixture can include a base having at least one wall that forms a cavity, where the at least one wall includes at least one lens mating surface. The light fixture can also include a lens having at least one base mating surface that forms a hermetic seal with the at least one lens mating surface, where the hermetic seal encapsulates the cavity. The light fixture can further include at least one solid state light source disposed within the cavity.

20 Claims, 2 Drawing Sheets

(56) References Cited

U.S. PATENT DOCUMENTS

| | | | | |
|---|---|---|---|---|
| 8,304,990 | B2 | 11/2012 | Aitken et al. | |
| 8,602,599 | B2 | 12/2013 | Zimmer et al. | |
| 8,845,134 | B2 | 9/2014 | Chiba et al. | |
| 2011/0019416 | A1 | 1/2011 | Poissonnet et al. | |
| 2011/0194280 | A1 | 8/2011 | Ruffin, Jr. et al. | |
| 2011/0273879 | A1* | 11/2011 | Hochstein | F21V 29/004 362/235 |
| 2012/0155080 | A1* | 6/2012 | Schupple | F21V 19/0055 362/235 |
| 2013/0094176 | A1* | 4/2013 | Deeman | F21V 9/16 362/84 |

* cited by examiner

HERMETICALLY-SEALED LIGHT FIXTURE FOR HAZARDOUS ENVIRONMENTS

TECHNICAL FIELD

Embodiments described herein relate generally to light fixtures, and more particularly to systems, methods, and devices for hermetically-sealed light fixtures for hazardous environments.

BACKGROUND

In hazardous environments, especially in areas that have potentially combustible sources such as sparks and excessive heat, these combustible sources must be contained to prevent an explosion or other harmful event. A light fixture can have one or more combustible sources. For example, a light fixture can have a power source and a light source, each of which can be a source of excessive heat.

SUMMARY

In general, in one aspect, the disclosure relates to a light fixture. The light fixture can include a base having at least one wall that forms a cavity, where the at least one wall includes at least one lens mating surface. The light fixture can also include a lens having at least one base mating surface that forms a hermetic seal with the at least one lens mating surface, where the hermetic seal encapsulates the cavity. The light fixture can further include at least one solid state light source disposed within the cavity.

In another aspect, the disclosure can generally relate to a lighting system. The lighting system can include a power supply and a light fixture electrically coupled to the power supply. The light fixture of the lighting system can include a base having at least one wall that forms a cavity, where the at least one wall includes at least one lens mating surface. The light fixture of the lighting system can also include a lens having at least one base mating surface that forms a hermetic seal with the at least one lens mating surface, where the hermetic seal encapsulates the cavity. The light fixture of the lighting system can further include at least one solid state light source disposed within the cavity.

In yet another aspect, the disclosure can generally relate to an enclosure. The enclosure can include a base having at least one wall that forms a cavity, where the at least one wall includes at least one cover mating surface, and where the at least one wall has a first coefficient of thermal expansion. The enclosure can also include a cover having at least one deflection member and at least one base mating surface that forms a hermetic seal with the at least one cover mating surface, where the hermetic seal encapsulates the cavity, and where the cover has a second coefficient of thermal expansion. The enclosure can further include at least one heat-generating device disposed within the cavity. The first coefficient of thermal expansion can differ from the second coefficient of thermal expansion by an amount. The at least one deflection member can change form to maintain the hermetic seal when the base, when exposed to heat, expands at a different rate than the cover.

These and other aspects, objects, features, and embodiments will be apparent from the following description and the appended claims.

BRIEF DESCRIPTION OF THE DRAWINGS

The drawings illustrate only example embodiments of hermetically-sealed light fixtures for hazardous environments and are therefore not to be considered limiting of its scope, as hermetically-sealed light fixtures for hazardous environments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
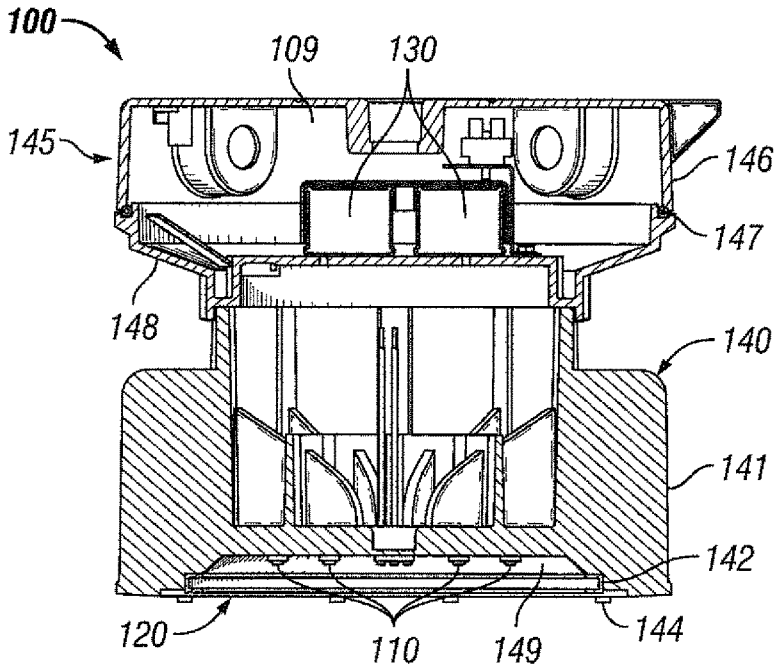
FIG. 1 (Prior Art)
FIGS. 1 and 2 show various light fixtures that are not hermetically-sealed and cannot be used in hazardous environments, as currently known in the art.

The example embodiments discussed herein are directed to systems, apparatuses, and methods of hermetically-sealed light fixtures for hazardous environments. As used herein, the term "hermetic" means impervious to gases, dust, and liquids. In such a case, the example light fixtures described herein can prevent gases that are present outside of the light fixture from entering some or all of the light fixture. Also, while example embodiments described herein are directed to hermetically-sealed light fixtures, other types heat-generating devices aside from light sources can be used with example embodiments. Examples of such other heat-generating devices can include, but are not limited to, a controller, a switch, a computer, a breaker, a relay, a terminal block, and an indicator. Such heat-generating devices can be a solid state device. Further, aside from light fixtures, example embodiments can be used with any of a number of enclosures that enclose one or more heat-generating devices and have adjacent components (e.g., cover, body) with coefficients of thermal expansion that differ from each other by a minimal amount. Therefore, example embodiments should not be limited to light fixtures that are hermetically-sealed.

Example embodiments can include light fixtures having one or more of a number of types of light sources, solid state devices, and/or other heat-generating devices. Example embodiments can include at least heat-generating device that is heat sunk to manage the heat generated by the at least one heat-generating device, while also having a hermetic seal of the at least one heat-generating device to prevent contact between the at least one heat-generating device (a source of heat) and explosive gas in the adjacent ambient environment. Heat-generating devices described herein can include solid state light sources, which use semiconductors to convert electricity into light. Examples of solid state light sources can include, but are not limited to, light-emitting diodes (LEDs), organic LEDs (OLEDs), and light-emitting polymers. If the heat-generating device is a LED, the LED can be one or more of a number of types of LED technology, including but not limited to discrete LEDs, LED arrays, chip-on-board LEDs, edge lit LED panels, and surface mounted LEDs.

An example light fixture can be electrically coupled to a power source to provide power and/or control to the light fixture. The power source can provide the example light fixture with one or more of a number (and/or a range) of voltages, including but not limited to 120 V alternating current (AC), 110 VAC, 240 VAC, 24 V direct current (DC), and 0-10 VDC. An example light fixture described herein can be considered an electrical enclosure. The example embodiments discussed herein can be used in any type of hazardous environment, including but not limited to an airplane hangar, a drilling rig (as for oil, gas, or water), a production rig (as for oil or gas), a refinery, a chemical plant, a power plant, a mining operation, a wastewater treatment facility, and a steel mill. A user may be any person that interacts with example hermetically-sealed light fixtures for hazardous environments. Examples of a user may include, but are not limited to, an engineer, an electrician, an instrumentation and controls technician, a mechanic, an operator, a consultant, a contractor, and a manufacturer's representative.

The example light fixtures (or components thereof) described herein can be made of one or more of a number of suitable materials to allow the light fixture to maintain durability in light of the one or more conditions under which the light fixtures can be exposed. Examples of such materials can include, but are not limited to, aluminum, stainless steel, fiberglass, glass, glass-filled polycarbonate, non-glass-filled polycarbonate, plastic, ceramic, and rubber. As a specific example, a heat sink can be made of aluminum, a housing can be made of a glass-filled polycarbonate material, and a lens can be made of a non-glass-filled polycarbonate material.

In certain example embodiments, the hermetically-sealed light fixtures described herein are subject to meeting certain standards and/or requirements. For example, the National Electric Code (NEC), the National Electrical Manufacturers Association (NEMA), Underwriters Laboratories (UL), the International Electrotechnical Commission (IEC), the Canadian Standards Association (CSA), and the Institute of Electrical and Electronics Engineers (IEEE) set standards as to light fixtures, wiring, and electrical connections. Use of example embodiments described herein meet (and/or allow a corresponding device to meet) such standards when required. In some (e.g., PV solar) applications, additional standards particular to that application may be met by the example light fixtures.

Example hermetically-sealed light fixtures for hazardous environments, or portions thereof, described herein can be made from a single piece (as from a mold, injection mold, die cast, or extrusion process). In addition, or in the alternative, example embodiments (or portions thereof) can be made from multiple pieces that are mechanically coupled to each other. In such a case, the multiple pieces can be mechanically coupled to each other using one or more of a number of coupling methods, including but not limited to epoxy, welding, overmolding, fusion, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

The example light fixtures described herein can be of any size and/or shape, and can have any number of sockets. Such light fixtures can be located indoor and/or outdoors and can be mounted to a surface (e.g., wall, ceiling, pillar), be part of a lamp, or be used with any other suitable mounting instrument where an example light fixture can be used. Such light fixtures can be used in residential, commercial, and/or industrial applications. Such light fixtures can operate from a manual control (e.g., on/off switch, dimming switch, pull chain), a photocell, a timer, and/or any other suitable mechanism.

While example embodiments described herein are directed to new hermetically-sealed light fixtures for hazardous environments, example embodiments can also be applied in retrofit applications using one or more parts (e.g., a base) of an existing light fixture. Further, example embodiments should not be limited to light fixtures that use any particular lighting technology.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

In the foregoing figures showing example embodiments of hermetically-sealed light fixtures for hazardous environments, one or more of the components shown may be omitted, repeated, and/or substituted. Accordingly, example embodiments of hermetically-sealed light fixtures for hazardous environments should not be considered limited to the specific arrangements of components shown in any of the figures. For example, features shown in one or more figures or described with respect to one embodiment can be applied to another embodiment associated with a different figure or description.

Example embodiments for hermetically-sealed light fixtures for hazardous environments will be described more fully hereinafter with reference to the accompanying drawings, in which example embodiments of hermetically-sealed light fixtures for hazardous environments are shown. Hermetically-sealed light fixtures for hazardous environments may, however, be embodied in many different forms and should not be construed as limited to the example embodiments set forth herein. Rather, these example embodiments are provided so that this disclosure will be thorough and complete, and will fully convey the scope of hermetically-sealed light fixtures for hazardous environments to those or ordinary skill in the art. Like, but not necessarily the same, elements (also sometimes called components) in the various figures are denoted by like reference numerals for consistency.

Terms such as "first", "second", "upper", "lower", and "within" are used merely to distinguish one component (or part of a component or state of a component) from another. Such terms are not meant to denote a preference or a particular orientation, and are not meant to limit embodiments of systems that integrate components of a sensor with a light fixture in hazardous environments. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
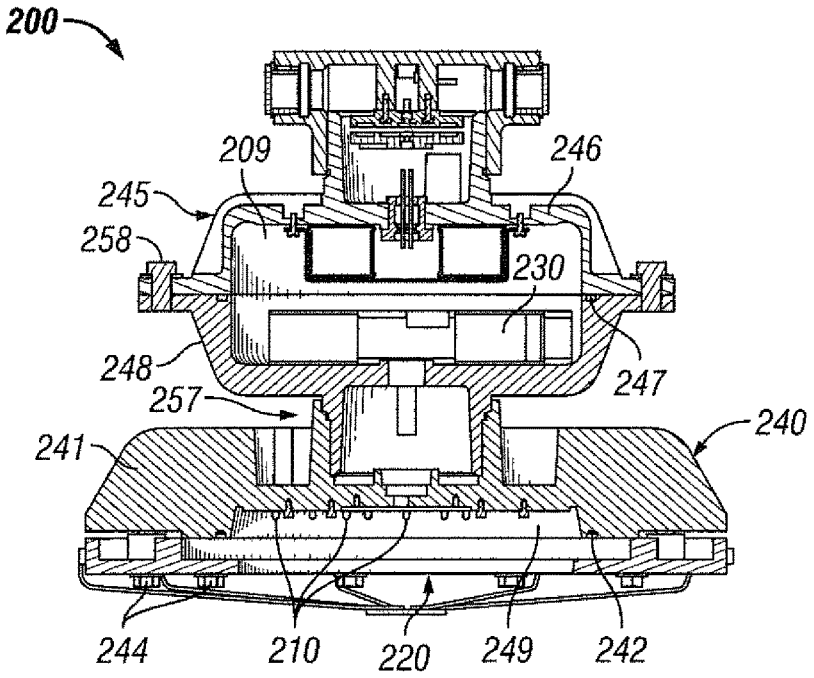
FIG. 2 (Prior Art)

FIGS. 1 and 2 show cross-sectional side views of a light fixture currently known in the art and that is not suitable for use in a hazardous environment. Specifically, FIG. 1 shows a cross-sectional side view of light fixture 100, and FIG. 2 shows a cross-sectional side view of light fixture 200.

Referring to FIGS. 1 and 2, the light fixture 100 of FIG. 1 includes a light source housing assembly 140 and a driver housing assembly 145. The driver housing assembly 145 has one or more components that are coupled to each other. In this case, the driver housing assembly 145 has an upper portion (defined by wall 146) and a lower portion (defined by wall 148) that are mechanically coupled to each other. The driver housing assembly 145, defined by wall 146 and wall 148, forms a cavity 109 inside of which one or more power sources 130 are disposed. A power source 130 can send power, control, and/or communication signals to a light source 110 (described below). Examples of a power source 130 can include, but are not limited to, a driver and a ballast.

The power source 130 can be a power supply. In other words, the power source 130 can be a source of independent power generation. For example, the power source 130 can include an energy storage device (e.g., a battery, a supercapacitor). As another example, the power source 130 can include photovoltaic solar panels. In addition, or in the alternative, the power source 130 can receive power from an independent power supply. The independent power supply can be any source of power that is independent of the power source 130. Examples of a power supply can include, but are not limited to, an energy storage device, a feed to a building, a feed from a circuit panel, and an independent generation source (e.g., photovoltaic panels, a heat exchanger).

A power source 130 can generate a substantial amount of heat during operation of the light fixture 100. As a result, one or more portions (e.g., the wall 146 of the upper portion, the wall 148 of the lower portion) of the driver housing assembly 145 that are located proximate to a power source 130 can be made of one or more thermally conductive materials. In this way, these portions of the driver housing assembly 145 can be in thermal communication with a power source 130 and help to absorb some of the heat generated by the power source 130 and subsequently dissipate the heat outside the cavity 109.

The upper portion and the lower portion of the driver housing assembly 145 are mechanically coupled to each other using one or more of a number of coupling means. Examples of such coupling means can include, but are not limited to, fastening devices (e.g., bolts, nuts), mating threads, slots, tabs, and detents. In this example, the upper portion and the lower portion are coupled to each other using mating threads (hidden from view). In any case, the coupling means are configured such that a user can manipulate the coupling means to separate the upper portion and the lower portion of the driver housing assembly 145 in order to access one or more components (e.g., a power source, wiring) disposed within the cavity 109 of the driver housing assembly 145.

When the upper portion and the lower portion of the driver housing assembly 145 are mechanically coupled to each other, a sealing device 147 (e.g., a gasket, an o-ring, silicone) can be disposed where the wall 146 of the upper portion abuts against the wall 148 of the lower portion. In such a case, the sealing device 147 can help prevent moisture, dust, gases, and/or other elements from outside the driver housing assembly 145 from entering the cavity 109. However, because of temperature cycling, which causes expansion and retraction of one or more components of the driver housing assembly 145, the sealing devices 147 can have reduced effectiveness. As a result, gases and other elements from outside the driver housing assembly 145 can still enter the cavity 109.

When the light fixture 100 is placed in a hazardous environment, and if certain combustible gases are able to seep into the cavity 109 of the driver housing assembly 145, an explosion can occur when the combustible gases are exposed to the heat generated by the power sources 130 in the cavity 109. As a result, the design of the driver housing assembly 145 prevents the light fixture 100 from complying with one or more standards applicable to light fixtures placed in hazardous environments, and so the light fixture 100 cannot be safely used in hazardous environments.

Like the driver housing assembly 145, the light source housing assembly 140 has one or more components that are coupled to each other. In this case, the light source housing assembly 140 has an upper portion (defined by wall 141) and a lower portion (defined by the lens 120) that are mechanically coupled to each other. The light source housing assembly 140, defined by wall 141 and lens 120, forms a cavity 149 inside of which one or more light sources 110 are disposed. A light source 110 can receive power, control, and/or communication signals from a power source 130.

A light source 110 can also emit light. As a result, each light source 110 can generate a substantial amount of heat during operation of the light fixture 100. As a result, one or more portions (e.g., the wall 141 of the upper portion) of the light source housing assembly 140 that are located proximate to a light source 110 can be made of one or more thermally conductive materials. In this way, these portions of the light source housing assembly 140 can be in thermal communication with a light source 110 and help to absorb some of the heat generated by the light source 110 and subsequently dissipate the heat outside the cavity 149.

The lens 120 (also called, among other names, a diffuser) can manipulate light emitted by the light sources 110 in one or more of a number of ways, including but not limited to filtering, diffusion, reflection, and refraction. The lens 120 can be opaque and prevent direct viewing of the light sources 110 while also helping to distribute (or otherwise control) the light generated by the light sources 110. The lens 120 can also protect the light sources 110 and/or other components of the light fixture 100 in the cavity 149.

The upper portion and the lower portion of the light source housing assembly 140 are mechanically coupled to each other using one or more of a number of coupling means, as described above. In this example, the upper portion and the lower portion are coupled to each other by a number of fastening devices 144 (in this case, bolts). The coupling means are configured such that a user can manipulate the coupling means to separate the upper portion and the lower portion of the light source housing assembly 140 in order to access one or more components (e.g., a light source, a circuit board) disposed within the cavity 149 of the light source housing assembly 140.

When the upper portion and the lower portion of the light source housing assembly 140 are mechanically coupled to each other, a sealing device 142 (e.g., a gasket, an o-ring, silicone) can be disposed where the wall 141 of the upper portion abuts against the lens 120 of the lower portion. In such a case, the sealing device 142 can help prevent moisture, dust, gases, and/or other elements from outside the light source housing assembly 140 from entering the cavity 149. However, because of temperature cycling, which causes expansion and retraction of one or more components of the light source housing assembly 140, the sealing devices 142 can have reduced effectiveness. As a result, gases and other elements from outside the light source housing assembly 140 can still enter the cavity 149.

When the light fixture 100 is placed in a hazardous environment, and if certain combustible gases are able to seep into the cavity 149 of the light source housing assembly 140, an explosion can occur when the combustible gases are exposed to the heat generated by the light sources 110 in the cavity 149. As a result, the design of the light source housing assembly 140 prevents the light fixture 100 from complying with one or more standards applicable to light fixtures placed in hazardous environments, and so the light fixture 100 cannot be safely used in hazardous environments.

The light source housing assembly 140 and the driver housing assembly 145 of the light fixture 100 are coupled to each other in one or more of a number of ways. For example, as shown in FIG. 1, the light source housing assembly 140 and the driver housing assembly 145 are mechanically and electrically coupled to each other. In some cases, either one of the light source housing assembly 140 and the driver housing assembly 145 is omitted, and some or all of the components of the omitted assembly is disposed within the remaining assembly. The light fixture 100 of FIG. 1 can be a Class 1, Division 1 light fixture (according to NEC standards, substantially similar IEC standards, and/or substantially similar standards of one or more other applicable standard-setting entities), which limits the temperature of its internal heat-generating components (e.g., light sources 110) so that those components do not ignite the occurrence of combustible gas. The Class 1, Division 1 rating for the light fixture 100 of FIG. 1 can also require that the fixture is unable to "breath" (prevents ingress) so as to reduce the probability that heat-generating components of the light fixture 100 will be contacted by the combustible gas within the cavity 149.

The light fixture 200 of FIG. 2 is substantially the same as the light fixture 100 of FIG. 1, except as described below. In this case, the upper portion 246 and the lower portion 248 of the driver housing assembly 245 of the light fixture 200 of FIG. 2 are coupled to each other a number of fastening devices 258 (in this case, bolts). Also, in this case, there is a gap 257 between a portion of the driver housing assembly 245 and the light source housing assembly 240 when they are coupled to each other. The light fixture 200 of FIG. 2 can be a Class 1, Division 2 light fixture (according to NEC standards, substantially similar IEC standards, and/or substantially similar standards of one or more other applicable standard-setting entities), which "breathes" (allows ingress) and so allows gas from outside the light fixture 200 to contact heat-generating devices (e.g., light sources 210) in the cavity 249. If the gas is combustible, the gas can ignite within the cavity 249. The light fixture 200 can be explosion-proof, which is designed to extinguish a flame or explosion generated within the cavity 249.

Figure 3:
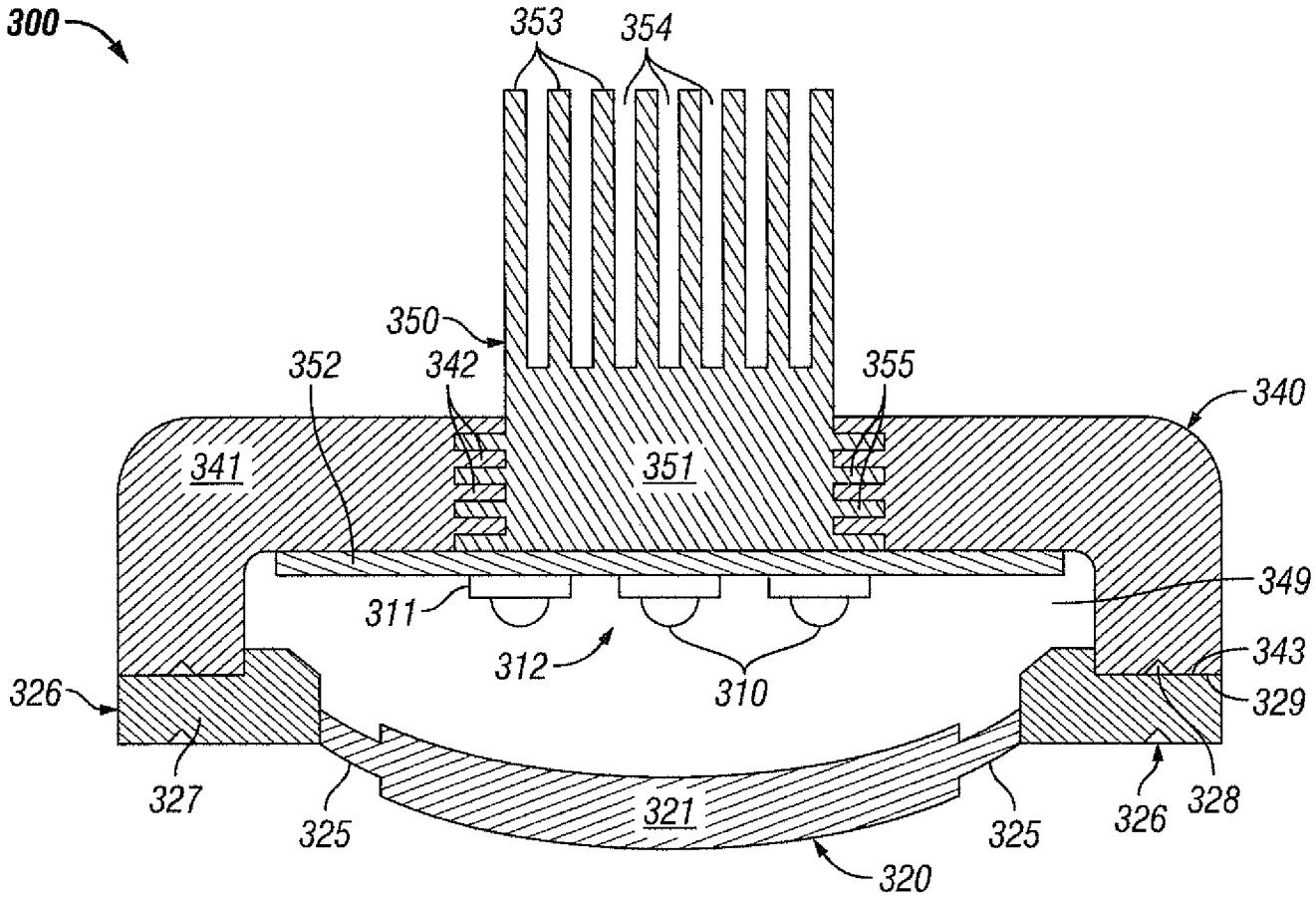
FIG. 3 shows a cross-sectional side view of a hermetically-sealed light fixture in accordance with certain example embodiments.

FIG. 3 shows a cross-sectional side view of a hermetically-sealed light fixture 300 in accordance with certain example embodiments. The light fixture 300 (and its various components) of FIG. 3 is substantially the same as the light fixture 100 (and its various components) of FIG. 1 and the light fixture 200 (and its various components) of FIG. 2, except as described below. Generally, example embodiments, such as the light fixture 300 of FIG. 3, use hermetic sealing in such a way that the light fixture 300 can be used under both Division 1 and Division 2 applications, regardless of the class (e.g., Class 1, Class 2, Class 3) of the NEC standards, substantially similar IEC standards, and/or substantially similar standards of one or more other applicable standard-setting entities. As explained below, example embodiments accounts for discrepancies in coefficients of thermal expansion for adjacent component of the light fixture 300, which allows for maintenance of the hermetic seal while also providing superior thermal management from the heat-generating components of the light fixture 300.

Referring to FIGS. 1-3, the light fixture 300 of FIG. 3 has only a single cavity 349 that is defined by the light source housing assembly 340 (in this case, also called the base 340 of the light fixture 300) and the lens 320. In alternative embodiments, the example light fixture 300 can have multiple cavities, formed by components of the light fixture 300 such as the light source housing assembly and the driver housing assembly, as described above. Here, the base 340 has at least one wall 341 that helps form the cavity 349.

The base 340 of the light fixture 300 can also include one or more lens mating surfaces 343 that abut against and couple to the lens 320 when the lens 320 is coupled to the base 340. Specifically, in this case, the lens mating surfaces 343 form a hermetic seal 328 with the base 340. A lens mating surface 343 can have any of a number of features and/or characteristics. Examples of such features and/or characteristics can include, but are not limited to, a smooth surface, a flat surface, a textured surface, a non-planar surface, a planar surface, a recessed portion, a protruding portion, a slot, a tab, and a channel.

In certain example embodiments, the base 340 can be made of one or more materials so that the coefficient of thermal expansion (CTE) of the base 340 can be a certain value or fall within a certain range of values. For example, the CTE of the base 340 can be approximately 21.5. To achieve the desired CTE, the base 340 can be made, in whole or in part, of a glass-filled polycarbonate material. In addition, or in the alternative, the base 340 of the light fixture 300 can be made of at least one polymeric material.

The base 340 can include, or can have coupled thereto, a heat sink 350. When the heat sink 350 is a separate piece from the base 340, the heat sink 350 can be disposed within an aperture in the wall 341 of the base 340. The heat sink 350 can include a body 351. The body 351 of the heat sink 350 can include one or more features disposed on an outer surface of the body 351. For example, in this case, the body 351 of the heat sink 350 includes a number of protrusions 353 (e.g., fins) that extend radially away from the body 351, a number of protrusions 355 that extend laterally away from the body 351, and a host surface 352. The radial protrusions 353 can be exposed to the ambient air and lead to an effective increase in surface area of the heat sink 350, which allows for more effective heat dissipation. The radial protrusions 353 can be spaced apart from adjacent radial protrusions 353 to form air gaps 354 therebetween.

The lateral protrusions 355 of the heat sink 350 can be used to more effectively couple the heat sink 350 with the base 340. Gaps formed between adjacent lateral protrusions 355 can be filled with protrusions 342 that extend from the body 341 of the base 340. The base 340 and the heat sink 350 can be coupled to each other in one or more of a number of ways. For example, the wall 341 of the base 340 can be overmolded with the body 351 of the heat sink 350. In such a case, the protrusions 342 that extend from the body 341 of the base 340 can be molded over, and fill the gaps between, the lateral protrusions 355 of the heat sink 350.

The host surface 352 of the heat sink 350 can be disposed within the cavity 349 and can be thermally coupled to at least one of the light sources 310. For example, as shown in FIG. 3, the light engine 312 (described below) can be coupled to the host surface 352 of the heat sink 350. The heat sink 350 can be made of one or more of a number of thermally conductive materials (e.g., aluminum). Like the base 340, the heat sink 350 can have a CTE that has a certain value or that falls within a certain range of values. For example, the CTE of the heat sink 350 can be approximately 22.2.

When the CTE of the heat sink 350 is substantially similar to the CTE of the base 340, this can help ensure that the coupling between the heat sink 350 and the base 340 is well sealed. In such a case, the coupling between the heat sink 350 and the base 340 can form a hermetic seal 328 without the risk of the junction between the heat sink 350 and the base 340 deteriorating over time and lose its hermetic quality. The similarity of CTEs between the heat sink 350 and the base 340 can also result in high thermal conductivity between the heat sink 350 and the base 340.

In this case, there are a number of light engines 312 inside the cavity 349, where each light engine 312 includes at least one light source 310 and a circuit board 311 (also called, among other names, a printed circuit board, a PCB, a printed wiring board, a PWB, and a wiring board). The circuit board 311 can include one or more of a number of components (e.g., integrated circuits, resistors, capacitors, diodes) that provide, directly or indirectly, power, control, and/or communication signals to the light sources coupled to that circuit board 311. In some cases, the power source (as described above) for the light fixture 300 is integrated with, or disposed on, the circuit board 311.

Because the cavity 349 of the light fixture 300 is hermetically sealed, relatively longer-lasting lighting technologies can be used to extend the useful life of the light fixture 300 for use in a hazardous environment. As a result, one or more of the light sources 310 can be a LED. In such a case, the light source 310 acts as a source of heat. Further, if the power source is integrated with the circuit board 311 in the cavity 349, then the transfer of heat from the cavity 349 to the ambient environment is important to remove another potential source of combustion.

In certain example embodiments, the power source for the light fixture 300 can receive power in one or more of a number of ways. For example, in addition to the relatively standard methods discussed previously, a power source of the example light fixture 300 can receive power inductively (e.g., using an inductor located proximate to a power cable located proximate to the light fixture 300). When inductive power is used to provide power to a power source of the light fixture 300, the light fixture 300 (or a portion thereof) can be replaced without de-energizing the light fixture 300 and/or other circuits associated with the light fixture.

As another example, one or more potted conductors can be disposed within a wall of a component (e.g., the wall 341 of the base 340) to provide power to a power source of the light fixture 300. As yet another example, an electrical connector can be disposed (e.g., overmolded) within a wall of a component (e.g., the wall 341 of the base 340) to provide power to a power source of the light fixture 300.

In certain example embodiments, the lens 320 of the light fixture 300 includes multiple portions. For example, in this case, the lens 320 can include a main portion 321, at least one deflection member 325 located adjacent to the main portion 321, and at least one end portion 326 located along the outer perimeter of the lens 320. The main portion 321 can be substantially similar to the lens described above with respect to FIGS. 1 and 2.

The lens 320 (or portions thereof) can be made of a polymeric material, which can be the same or a different polymeric material used for the base 340. In addition, or in the alternative, the lens 320 (or portions thereof) can be made of a non-glass-filled polycarbonate material. The CTE of the lens 320 can be relatively high compared to (marginally or substantially greater than) the CTE of the base 340 and/or the CTE of the heat sink 350. For example, the CTE of the lens 320 can be approximately 70.2.

The deflection member 325 can be discrete or continuous along all or a portion of the lens 320. For example, if the lens 320 (when viewed from above) is circular in shape, the deflection member 325 can be a continuous ring disposed between the main portion 321 and the end portion 326. The deflection member 325, while forming continuously and seamlessly with the main portion 321 and the end portion 326 of the lens 320, include one or more of a number of features that allow the deflection member 325 to change form (e.g., become compressed, buckle, become deflected) while maintaining the continuity and seamlessness with the main portion 321 and the end portion 326 of the lens 320.

In other words, the deflection member 325 can change form while still maintaining the encapsulation of the cavity 349, and thus maintaining the hermetic seal 328 between the lens 320 and the base 340. Examples of a feature of a deflection member 325 can include, but are not limited to, a reduced thickness, a see-saw shape along its length, an indentation, a recess, and a protrusion. Such features of the deflection member 325 can be continuous or discrete along all or a portion of the deflection member 325.

The deflection member 325 can be important if the CTE of lens 320 is significantly different from the CTE of the base 340. In such a case, during high temperature conditions, the component (e.g., the lens 320) with the higher CTE can expand more quickly than the component (e.g., the base 340) with the lower CTE. In such a case, the hermetic seal 328 can become compromised without something to compensate for this difference in CTE. The deflection member 325 can change form when the lens 320 expands more quickly than the base 340 during high temperatures.

In certain example embodiments, the deflection member 325 can be resilient. In other words, the deflection member 325 can change form at higher temperatures, and then revert to a substantially normal form (e.g., original form, previous form) or position at lower temperatures. The deflection member 325 can also be configured to be resilient over a number of cycles of temperature changes. In some cases, other components (e.g., the base 340) of the light fixture 300 can have one or more deflection members in addition to, or instead of, the deflection member 325 of the lens 320.

In addition to, or in the alternative of, the deflection member 325 being disposed on the lens 320, one or more deflection members 325 can be disposed on one or more other portions of the light fixture 300. For example, the base 340 can have one or more deflection members 325 disposed thereon. In such a case, the deflection members 325 may be located proximate to the lens 320 so that the hermetic seal 328 between the base mating surfaces 329 and the lens mating surfaces 343 can be maintained.

The end portion 326 of the lens 320 can include a body 327 and at least one base mating surface 329. Each base mating surface 343 abuts against and couples to a corresponding lens mating surface 343 when the lens 320 is coupled to the base 340. Specifically, in this case, the base mating surfaces 329 form a hermetic seal 328 with the lens mating surfaces 343. A base mating surface 329 can have any of a number of features and/or characteristics. Such features and/or characteristics of a base mating surface 329 can be the same as, or different than, the features and/or characteristics of the corresponding lens mating surface 343.

The hermetic seal 328 between the base mating surfaces 329 and the lens mating surfaces 343 encapsulates the cavity 349. The hermetic seal 328 can be formed using one or more of a number of methods. Such methods can include, but are not limited to, ultrasonic welding, epoxy, melting, and soldering. In certain example embodiments, when the lens 320 and the base 340 are made of certain materials, a certain method of forming a hermetic seal 328 between the lens 320 and the base 340 can be used to generate a longer-lasting encapsulation of components (e.g., light engines 312) of the light fixture 300 located in the cavity 349. For example, if the lens 320 and the base 340 are made, at least in part, of polymeric material, an ultrasonic weld can be used to create a stronger hermetic seal 328.

In example embodiments, the hermetic seal 328 can prevent the ingress of elements (e.g., gas, water) from outside the light fixture 300 from entering the cavity 349. In addition, when one or more components (e.g., the base 340, the lens 320) of the light fixture 300 are made of polymeric material, the cost of creating these components can be greatly reduced compared to the cost of comparable components made with other materials (e.g., metal, ceramic). In this way, example hermetically-sealed light fixtures can be manufactured at lower cost, and yet have a longer functional existence in a hazardous environment.

Example embodiments provide a relatively low cost light fixture that can be used in hazardous environments. Further, the design of one or more components of the example light fixtures described herein provide a more reliable, longer-lasting hermetic seal for the light fixture while exposed to a hazardous environment. When inductive power is used to provide power to an example light source, the light source can be replaced without complicated electrical and/or mechanical manipulation or expertise.

Example embodiments can be retrofit into at least a portion (e.g., the base) of an existing light fixture. As a result, many issues common to retrofitting a lighting fixture or installing a new light fixture (e.g., rewiring, drilling new holes, repairing a surface, hiring an electrician, buying an entirely new fixture) can be avoided or minimized. Using example embodiments described herein, the light fixture can be more energy efficient, provide particular types of lighting, and be easily changed at some point in the future.

In addition, example embodiments are more effective at eliminating ingress points for water, combustible gas, and other elements from outside the light fixture. As a result, example light fixtures can comply with any of a number of standards and/or regulations associated with hazardous environments. Thus, example light fixtures improve safety conditions in areas where the light fixtures are used.

Accordingly, many modifications and other embodiments set forth herein will come to mind to one skilled in the art to which hermetically-sealed light fixtures for hazardous environments pertain having the benefit of the teachings presented in the foregoing descriptions and the associated drawings. Therefore, it is to be understood that hermetically-sealed light fixtures for hazardous environments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light fixture disposed in a hazardous environment, comprising:

a base comprising at least one wall that forms a cavity, wherein the at least one wall comprises at least one lens mating surface;

a lens comprising at least one base mating surface that forms a hermetic seal with the at least one lens mating surface, wherein the hermetic seal comprises a fusion between the at least one base mating surface and the at least one lens mating surface, wherein the hermetic seal encloses the cavity; and at least one solid state light source disposed within the cavity.

2. The light fixture of claim 1, further comprising a heat sink disposed within an aperture in the at least one wall, wherein the heat sink is thermally coupled to the at least one solid state light source.

3. The light fixture of claim 2, wherein the heat sink has a first coefficient of thermal expansion, wherein the at least one wall of the base has a second coefficient of thermal expansion, and wherein the first coefficient of thermal expansion is substantially the same as the second coefficient of thermal expansion.

4. The light fixture of claim 2, wherein the at least one wall of the base is overmolded onto the heat sink.

5. The light fixture of claim 2, wherein the at least one wall of the base and the heat sink couple to each other to form an additional hermetic seal.

6. The light fixture of claim 1, wherein the at least one wall of the base is made of a first polymeric material.

7. The light fixture of claim 6, wherein the lens is made of a second polymeric material.

8. The light fixture of claim 1, wherein the hermetic seal is created using an ultrasonic weld between the at least one base mating surface and the at least one lens mating surface.

9. The light fixture of claim 1, wherein the lens further comprises at least one deflection member.

10. The light fixture of claim 9, wherein the hermetic seal is maintained when the at least one deflection member is deflected.

11. The light fixture of claim 10, wherein the lens remains continuous when the at least one deflection member is deflected.

12. The light fixture of claim 1, wherein the at least one wall of the base comprises a glass-filled polycarbonate material.

13. The light fixture of claim 12, wherein the lens comprises a polycarbonate material without glass.

14. The light fixture of claim 13, wherein the lens has a first coefficient of thermal expansion, wherein the at least one wall of the base has a second coefficient of thermal expansion, and wherein the first coefficient of thermal expansion is substantially greater than the second coefficient of thermal expansion.

15. The light fixture of claim 1, wherein the at least one solid state light source comprises a light-emitting diode.

16. The light fixture of claim 1, further comprising a power source disposed within the cavity of the base, wherein the power source provides power to the at least one solid state light source.

17. A lighting system, comprising:

a power supply; and a light fixture electrically coupled to the power supply, wherein the light fixture comprises:

a base comprising at least one wall that forms a cavity, wherein the at least one wall comprises at least one lens mating surface;

a lens comprising at least one base mating surface that forms a hermetic seal with the at least one lens mating surface, wherein the hermetic seal comprises a permanent adhesion between the at least one base mating surface and the at least one lens mating surface, wherein the hermetic seal encloses the cavity;

at least one solid state light source disposed within the cavity, where the light fixture is disposed in a hazardous environment.

18. The lighting system of claim 17, wherein the light fixture further comprises a power source, wherein the power source receives system power from the power supply and delivers, using the system power, power signals to the at least one light source.

19. An enclosure, comprising:

a first enclosure portion comprising at least one first wall made of a first material, wherein the at least one first wall comprises at least one first mating surface, and wherein the first material of the at least one first wall has a first coefficient of thermal expansion;

a second enclosure portion comprising at least one second wall made of a second material, wherein the at least one second wall comprises at least one deflection member and at least one second mating surface, wherein the first enclosure portion and the second enclosure portion, when coupled to each other, form a cavity, and wherein the second material of the second enclosure portion has a second coefficient of thermal expansion that is greater than the first coefficient of thermal expansion of the first material of the first enclosure portion; and at least one heat-generating device disposed within the cavity, wherein the at least one first mating surface and the at least one second mating surface abut against each other to form a seal, and wherein the at least one deflection member changes form to maintain the seal when the second enclosure portion, when exposed to heat, expands at a higher rate than the first enclosure portion.

20. The enclosure of claim 19, wherein the first enclosure portion and the second enclosure portion are disposed in a hazardous environment, and wherein the seal formed between the at least one first mating surface and the at least one second mating surface is a hermetic seal.

* * * * *